US007025098B2

(12) United States Patent
Osborne

(10) Patent No.: US 7,025,098 B2
(45) **Date of Patent: *Apr. 11, 2006**

(54) SYRINGE BANDOLEER WITH CONTROL FEATURE

(75) Inventor: Joel A. Osborne, Port Orange, FL (US)

(73) Assignee: ForHealth Technologies, Inc., Oklahoma City, OK (US)

( * ) Notice: Subject to any disclaimer, the term of this patent is extended or adjusted under 35 U.S.C. 154(b) by 122 days.

This patent is subject to a terminal disclaimer.

(21) Appl. No.: 10/763,475

(22) Filed: Jan. 22, 2004

(65) Prior Publication Data

US 2004/0250877 A1 Dec. 16, 2004

Related U.S. Application Data

(63) Continuation of application No. 10/001,244, filed on Nov. 15, 2001, now Pat. No. 6,722,404.

(51) Int. Cl.
*B65B 43/42* (2006.01)

(52) U.S. Cl. ..... 141/133; 141/35; 141/36; 141/94; 141/180; 53/167

(58) Field of Classification Search ..... 141/18, 141/27, 35, 36, 94, 129–133, 180, 250; 53/468, 53/167, 471, 492; 211/60.1, 113; 206/366; 422/104; 128/919; 224/223
See application file for complete search history.

(56) References Cited

U.S. PATENT DOCUMENTS 2,627,470 A 2/1953 Seiferth
2,880,723 A 4/1959 Adams
2,981,432 A 4/1961 Flood
3,527,017 A 9/1970 Taylor et al.
3,651,615 A 3/1972 Bohner et al.
3,676,271 A 7/1972 Hake et al.
3,736,933 A 6/1973 Szabo
3,823,818 A 7/1974 Shaw
3,835,897 A 9/1974 Gess
3,878,026 A 4/1975 Snyder et al.
3,880,211 A 4/1975 Gess
4,472,357 A 9/1984 Levy et al.
4,502,616 A 3/1985 Meierhoefer
4,512,472 A 4/1985 Jarund
4,512,475 A 4/1985 Federighi
4,624,148 A 11/1986 Averette
4,639,250 A 1/1987 Rycroft
4,674,652 A 6/1987 Aten et al.
4,702,788 A 10/1987 Okui
4,758,230 A 7/1988 Rycroft (Continued)

OTHER PUBLICATIONS

U.S. Appl. No. 10/626,506, Osborne.

*Primary Examiner*—Timothy L. Maust
(74) *Attorney, Agent, or Firm*—Darby & Darby

(57) ABSTRACT

A bandolier of syringes for use in an automated syringe handling system is provided. The automated syringe handling system generally receives syringes and fills the syringe with a substance, such as a medicament. In one exemplary embodiment, the syringe handling system is a system that disperses one or more medicaments into the syringes in an automated manner. The bandolier includes a web, e.g., a strip of transparent material partially encapsulating bodies of syringes that are bound to the web at a prescribed interval. The bandolier includes a feature disposed within the prescribed interval and between the syringes with the feature being different from the surrounding web.

24 Claims, 7 Drawing Sheets

U.S. PATENT DOCUMENTS 4,823,982 A 4/1989 Aten et al.
4,865,592 A 9/1989 Rycroft
5,019,048 A 5/1991 Margolin
5,188,696 A 2/1993 Good, Jr.
5,337,636 A 8/1994 Shea
5,341,854 A 8/1994 Zezulka et al.
5,356,393 A 10/1994 Haber et al.
5,380,296 A 1/1995 Smedley et al.
5,597,530 A 1/1997 Smith et al.
5,611,430 A 3/1997 Albrecht et al.
5,704,921 A 1/1998 Carilli
5,782,157 A 7/1998 Ellington et al.
5,805,454 A 9/1998 Valerino, Sr.
5,884,457 A 3/1999 Ortiz et al.
5,887,722 A 3/1999 Albrecht et al.
5,893,259 A 4/1999 Posge
5,911,252 A 6/1999 Cassel
6,048,086 A 4/2000 Valerino, Sr.
6,722,404 B1 * 4/2004 Osborne ..... 141/133
6,813,868 B1 * 11/2004 Baldwin et al. ..... 53/411
2002/0020459 A1 2/2002 Baldwin et al.
2004/0088951 A1 5/2004 Baldwin et al.

* cited by examiner

SYRINGE BANDOLEER WITH CONTROL FEATURE

CROSS-REFERENCE TO RELATED APPLICATION

This application is a continuation application of U.S. patent application Ser. No. 10/001,244, filed Nov. 15, 2001 now U.S. Pat. No. 6,722,404, and which is hereby incorporated by reference in its entirety.

FIELD OF THE INVENTION

The present invention relates generally to medical equipment, and more particularly, to unit dose, disposable syringes that are used for the delivery of fluids into an object, such as a human body or an animal's body.

BACKGROUND OF THE INVENTION

Disposable syringes are in widespread use for a number of different types of applications. For example, syringes are used not only to withdraw a fluid (e.g., blood) from a patient but also to administer a medicament to a patient. In the latter, a cap or the like is removed from the syringe and a unit does of the medicament is carefully measured and then injected or otherwise disposed within the syringe.

As technology advances, more and more sophisticated, automated systems are being developed for preparing and delivering medicaments by integrating a number of different stations, with one or more specific tasks being performed at each station. For example, one type of exemplary automated system operates as a syringe filling apparatus that receives user inputted information, such as the type of medicament, the volume of the medicament and any mixing instructions, etc. The system then uses this inputted information to disperse the correct medicament into the syringe up to the inputted volume.

In some instances, the medicament that is to be delivered to the patient includes more than one pharmaceutical substance. For example, the medicament can be a mixture of several components, such as several pharmaceutical substances.

By automating the medicament preparation process, increased production and efficiency are achieved. This results in reduced production costs and also permits the system to operate over any time period of a given day with only limited operator intervention for manual inspection to ensure proper operation is being achieved. Such a system finds particular utility in settings, such as large hospitals, including a large number of doses of medicaments have to be prepared daily. Traditionally, these doses have been prepared manually in what is an exacting but tedious responsibility for a highly skilled staff. In order to be valuable, automated systems must maintain the exacting standards set by medical regulatory bodies, while at the same time simplifying the overall process and reducing the time necessary for preparing the medicaments.

Because syringes are often used as the carrier means for transporting and delivering the medicament to the patient, it is advantageous for these automated systems to be tailored to accept syringes. There are a vast number of different types of syringes that are commercially available and some of those available may be improper for use with a given type of automated system. For example, the shape and/or dimensions of the syringe may prevent one syringe type from being used in a given automated system and can even cause damage due to jamming of the syringes as they are fed into the automated system.

What is needed in the art and has heretofore not been available is a system and method for automatically feeding a number of syringes into the automated system with the syringes being monitored and controlled so that only the proper syringe type is used and misalignment of the syringes is eliminated.

SUMMARY OF THE INVENTION

A bandolier of syringes for use in an automated syringe handling system is provided. The automated syringe handling system generally receives syringes and fills each syringe with a substance, such as a medicament. In one exemplary embodiment, the syringe handling system is a system that disperses one or more medicaments into the syringes in an automated manner.

According to one aspect of the present invention, a bandolier includes a web, e.g., a strip of transparent material, partially encapsulating bodies of syringes that are bound to the web at a prescribed interval. The bandolier includes a control feature disposed within the prescribed interval and between the syringes with the control feature being different from the surrounding web.

In accordance with another aspect of the invention, the control feature is used in combination with a detection system that is configured to detect the control feature. By incorporating the control feature into the bandolier structure, sufficient advance notification is provided indicating that the syringe bandolier is being misfed since the bandolier will not be advanced when the detection system fails to properly sense the control feature. A control system in accordance with this aspect of the invention includes an indexer configured to advance a syringe through the automated syringe handling system, a bandolier of syringes supplying syringes to the indexer, and a detection system including a detector positioned to detect the control feature on the bandolier and perform a prescribed operation in response to the detection or non-detection of the control feature.

In yet a further aspect of the invention, the use of the control feature can also ensure that only syringes of the correct type are used with the automated syringe handling system.

Further aspects and features of the exemplary syringe bandolier disclosed herein can be appreciated from the appended Figures and accompanying written description.

DETAILED DESCRIPTION OF A PREFERRED EMBODIMENT

Figure 1:
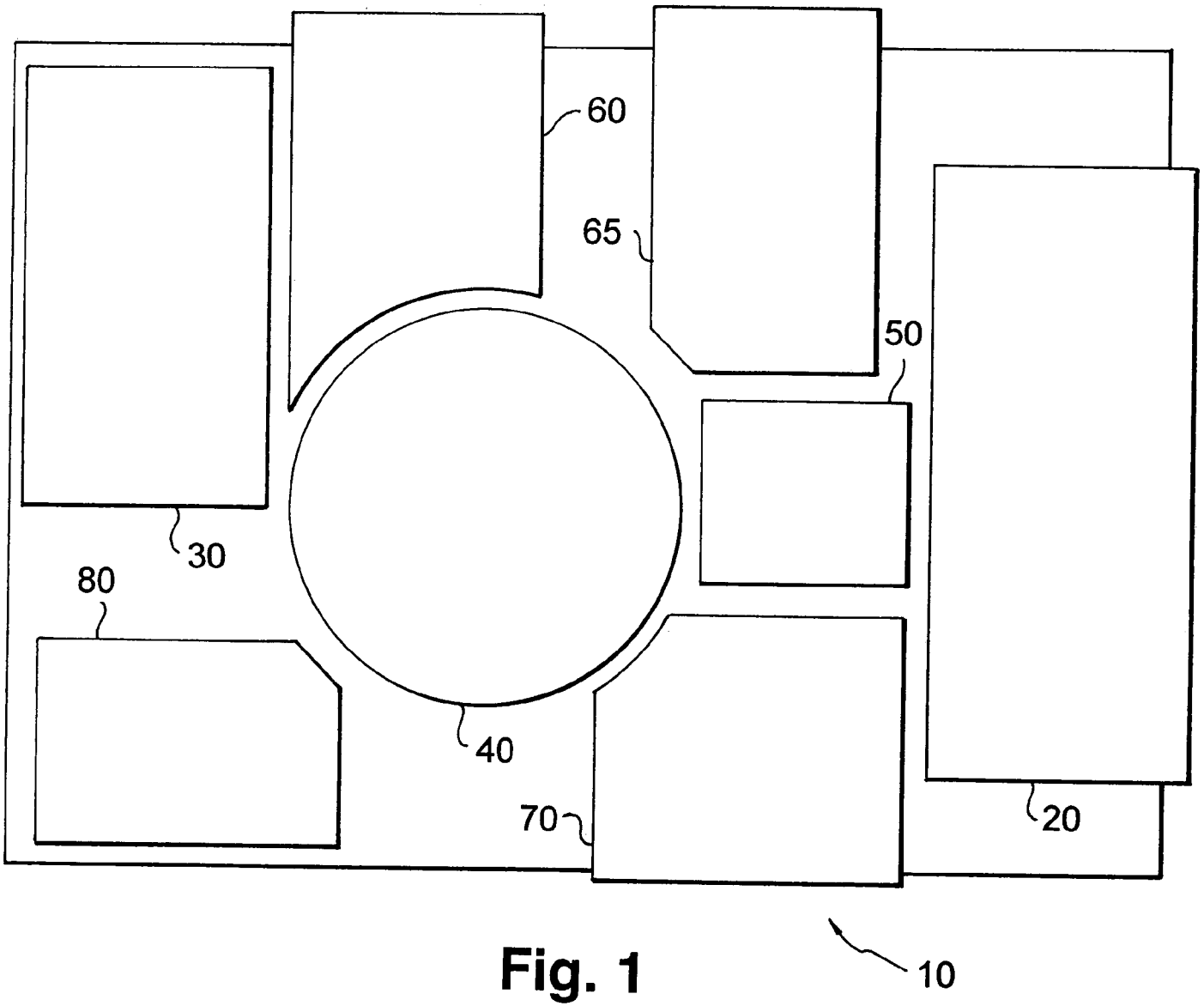
FIG. 1 is a schematic diagram of an automated system for dispersing a medicament.

FIG. 1 is a schematic diagram illustrating one exemplary automated system, generally indicated at 10, for the preparation of a medicament. The automated system 10 is divided into a number of stations where a specific task is performed based on the automated system 10 receiving user input instructions, processing these instructions and then preparing unit doses of one or more medicaments in accordance with the instructions. The automated system 10 includes a first station 20 where medicaments and other substances used in the preparation process are stored. As used herein, the term "medicament" refers to a medicinal preparation for administration to a patient. The medicament can include one or more pharmaceutical substances and can also include non-pharmaceutical substances, such as a diluent, etc. Thus, the first station 20 functions as a storage unit for storing one or medicaments, etc. under proper storage conditions. Typically, medicaments and the like are stored in sealed containers, such as vials, that are labeled to clearly indicate the contents of each vial.

A second station 30 is a syringe storage station 130 that houses and stores a number of syringes. For example, up to 500 syringes or more can be disposed in the second station 30 for storage and later use. The station 30 can be in the form of a bin or the like or any other type of structure than can hold a number of syringes.

The system 10 also includes a rotary apparatus 40 for advancing items to and from various stations of the system 10. A number of the stations are arranged circumferentially around the rotary apparatus 40 so that when an item is supported on, coupled to, or engaged by the rotary apparatus 40 at a first location and the rotary apparatus 40 is then advanced, the item is rotated to a next station where a different action occurs.

One exemplary type of rotary apparatus 40 is a multiple station cam-indexing dial that is adapted to perform material handling operations. The indexer is configured to have multiple stations positioned thereabout with individual nests for each station position. One syringe is held within one nest using any number of suitable techniques, including opposing spring-loaded fingers that act to clamp the syringe in its respective nest. The indexer permits the rotary apparatus 40 to be advanced at specific intervals.

The system 10 also preferably includes a reading device (not shown) that is capable of reading a label disposed on the sealed container containing the medicament. The label is read using any number of suitable reader/scanner devices, such as a bar code reader, etc., so as to confirm that the proper medicament has been selected from the storage unit of the first station 20. Multiple readers can be employed in the system at various locations to confirm the accuracy of the entire process. Once the system 10 confirms that the sealed container that has been selected contains the proper medicament, a safety cap or the like is removed from the sealed container. Preferably, the safety cap is removed in a just-in-time for use manner on a deck of the automated system 10.

The system 10 also preferably includes a station 50 for injecting a diluent into the medicament contained in the opened container and then subsequently mixing the medicament and the diluent. At a station 60, syringes are loaded into one of the nests of the rotary apparatus 40. One syringe is loaded into one nest of the rotary apparatus 40 in which the syringe is securely held in place. The system 10 preferably includes additional mechanisms for preparing the syringe for use, such as removing a tip cap and extending a plunger of the syringe. After the syringe is ready for use, the medicament (with diluent) is withdrawn from the medicament's container and is then disposed into the syringe at station 65. For example, a cannula can be inserted into the sealed container and the mixed medicament then aspirated into a cannula set. The cannula is then withdrawn from the container and positioned using the rotary apparatus 40 in line with (above, below, etc.) the syringe. The unit dose of the medicament is then delivered to the syringe, as well as additional diluent if necessary or desired. The tip cap is then placed back on the syringe. Another station 70 prints and applies a label to the syringe and one of the readers can be used to verify that this label is placed in a correct location and the printing thereon is readable. Also, the reader can confirm that the label properly identifies the medicament that is contained in the syringe. The syringe is then unloaded from the rotary apparatus 40 at a station 80 and delivered to a predetermined location, such as a new order bin, a conveyor, a sorting device, or a reject bin. The delivery of the syringe can be accomplished using a standard conveyor or other type of apparatus.

By automating the entire process by using one or more robotic devices having one or more arms for grasping objects and an index device (rotary device), the filling of syringes is done in a more cost effective and expedited manner. The robotic devices are part of a computer based system that permits the user to simply enter a command and this causes the robotic devices to be driven under program control to any number of locations to perform prescribed tasks.

Figure 2:
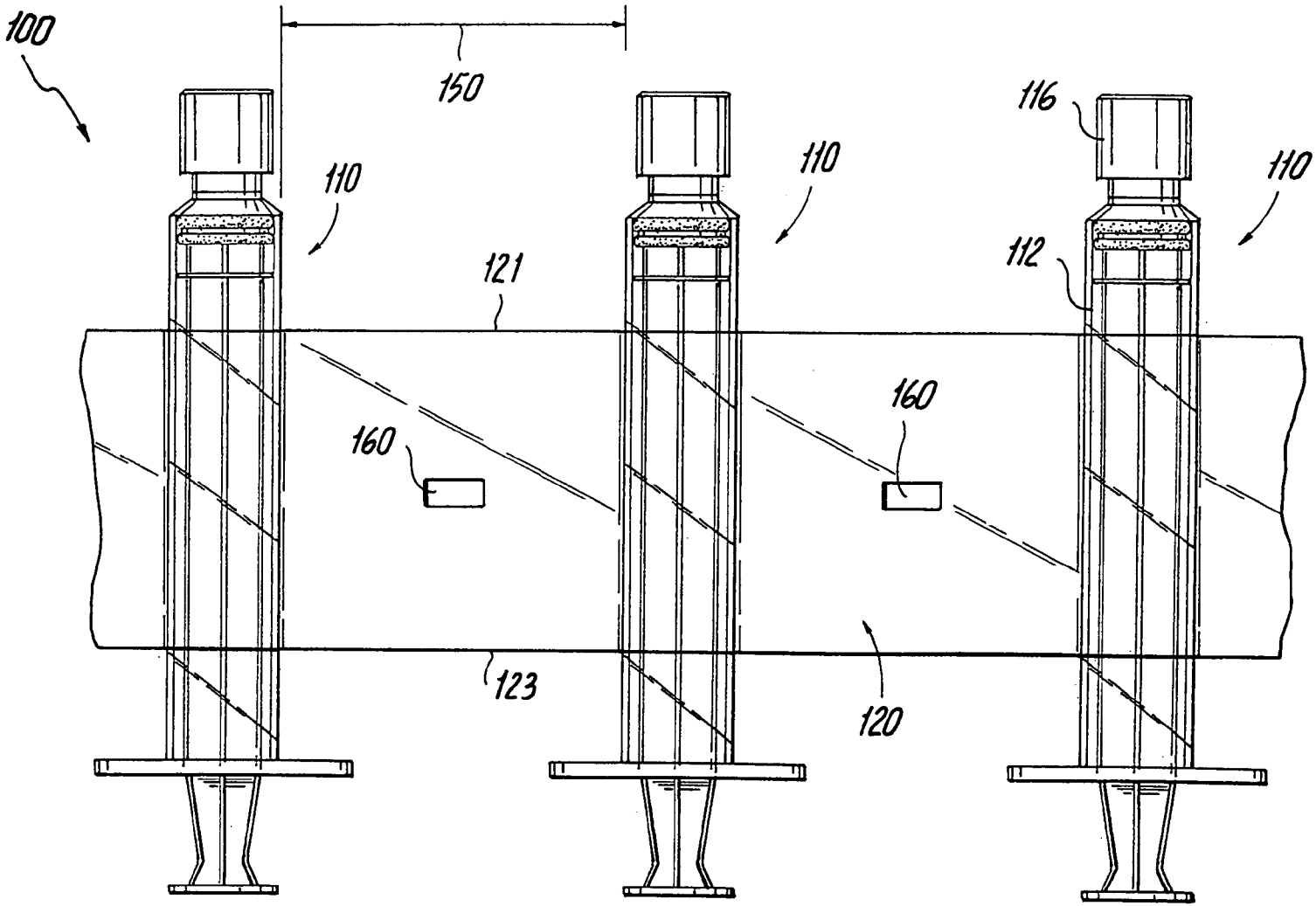
FIG. 2 is a side elevational view of a syringe bandolier according to one embodiment.
Figure 3:
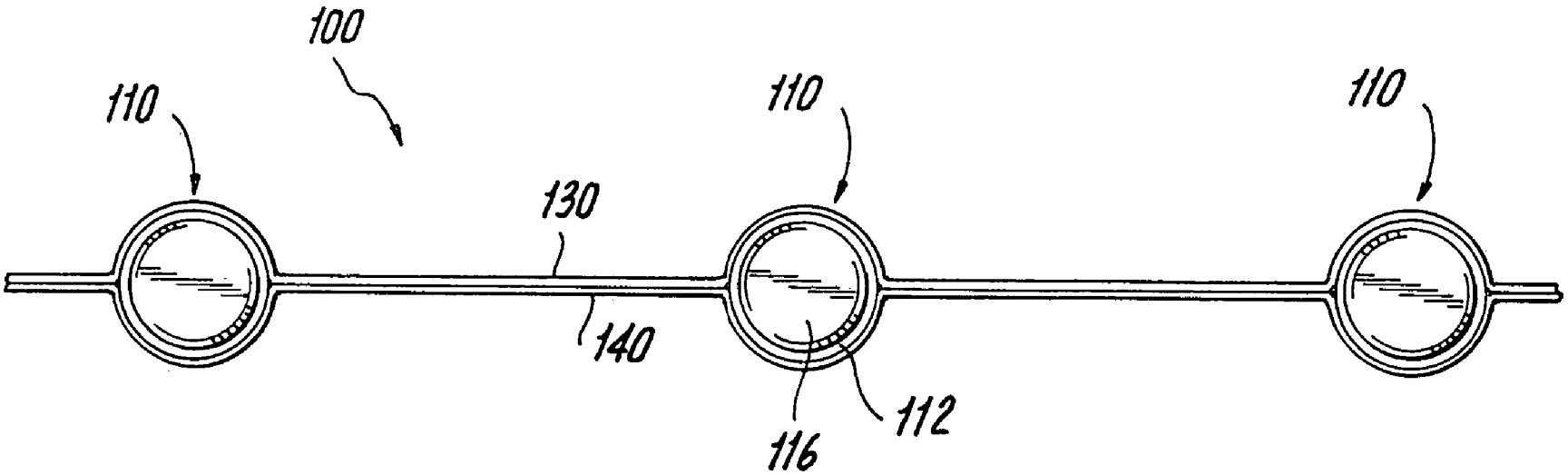
FIG. 3 is a top plan view of the syringe bandolier of FIG. 2.

Referring now to FIGS. 2–3, a bandolier-type syringe assembly is illustrated and generally indicated at 100. The bandolier 100 can be used with an automated system, such as the previously-described automated system 10. The bandolier of syringes 100 includes a number of syringes 110 spaced a predetermined distance from one another and attached to one another into a strip 120. The syringes 110 are traditional syringes with each having a body 112, a plunger 114 that is slidably received in the body 112, and a cap 116 at one end of the body 112. The cap 116 is preferably of a removable type and covers a syringe port that is used to receive and/or discharge fluid. The bandolier 100 is formed so that the syringes 110 are held in place and at predetermined spaced intervals within the strip 120 by a first strip layer 130 and a second strip layer 140. The syringes 110 are disposed between the first and second strip layers 130, 140 with the layers 130, 140 being form fitted so that they are disposed intimately over the contours of the syringes 110. It will be appreciated that syringes, such as syringes 110, come in a number of different shapes and sizes; however, the above-mentioned components thereof are typically common to most syringe constructions.

A number of different materials can be used to form the first and second strip layers 130, 140 so long as the material is adapted to perform the desired function of securely holding the syringes 110 in spaced relationship so as to form the bandolier 100. For example, the first and second strip layers 130, 140 can be formed of a plastic material. In this embodiment, the bandolier 100 can be assembled by first providing the first strip layer 130, then disposing the syringes 110 at the desired predetermined intervals along the first strip layer 130 before then disposing the second strip layer 140 over the syringes 110 opposite the first strip layer 130. The assembled first strip layer 130, syringes 110, and second strip layer 140 are then subjected to a process for causing the first and second strip layers 130, 140 to become in intimate contact with each other in the intervals between the syringes 110 and in intimate contact with the bodies of syringes 110. This results in the syringes 110 being securely held between the first and second strip layers 130, 140 at the desired spaced interval distances. One type of process for achieving such a result involves the use of a vacuum type system that evacuates the air between the first and second strip layers 130, 140 and causes the syringes 110 to be secured and held in the desired locations along the strip 120. It will also be appreciated that an adhesive or a heat weld can be used between the first and second strip layers 130, 140 for producing the final bandolier 100.

The strip 120 is defined by an upper edge 121 and a lower edge 123 with each syringe 110 extending beyond both the upper edge 121 and the lower edge 123. More specifically, the first and second strip layers 130, 140 are positioned in the region of the syringe body 112 so that the layers 130, 140 seal against this body portion 112 in the completed bandolier 100. Because the syringes 110 bound to the strip 120 are spaced along the strip at predetermined locations, prescribed intervals 150 are formed between the syringes 110. In other words, between next adjacent syringes 110, one prescribed interval 150 is formed and consists of the first and second strip layers 130, 140 sealed to one another. Preferably, the length of each prescribed interval 150 is the same along the length of the entire bandolier 100.

The bandolier 100 has a control feature, generally indicated at 160, incorporated therein to ensure that the bandolier 100 is properly aligned in a system that it is being used in, such as the automated system 10, and also to ensure that the syringes 110 of the bandolier 100 have specifications, e.g., dimensions, that fall within the acceptable specifications of the system with which the bandolier 100 is being used. The control feature 160 is formed in each prescribed interval 150 between next adjacent syringes 110. The control feature 160 is configured so that a detection mechanism, such as a reader or other type of similar device, can detect the presence or absence, as well as the location of the control feature 160 within the prescribed interval 150.

Figure 4:
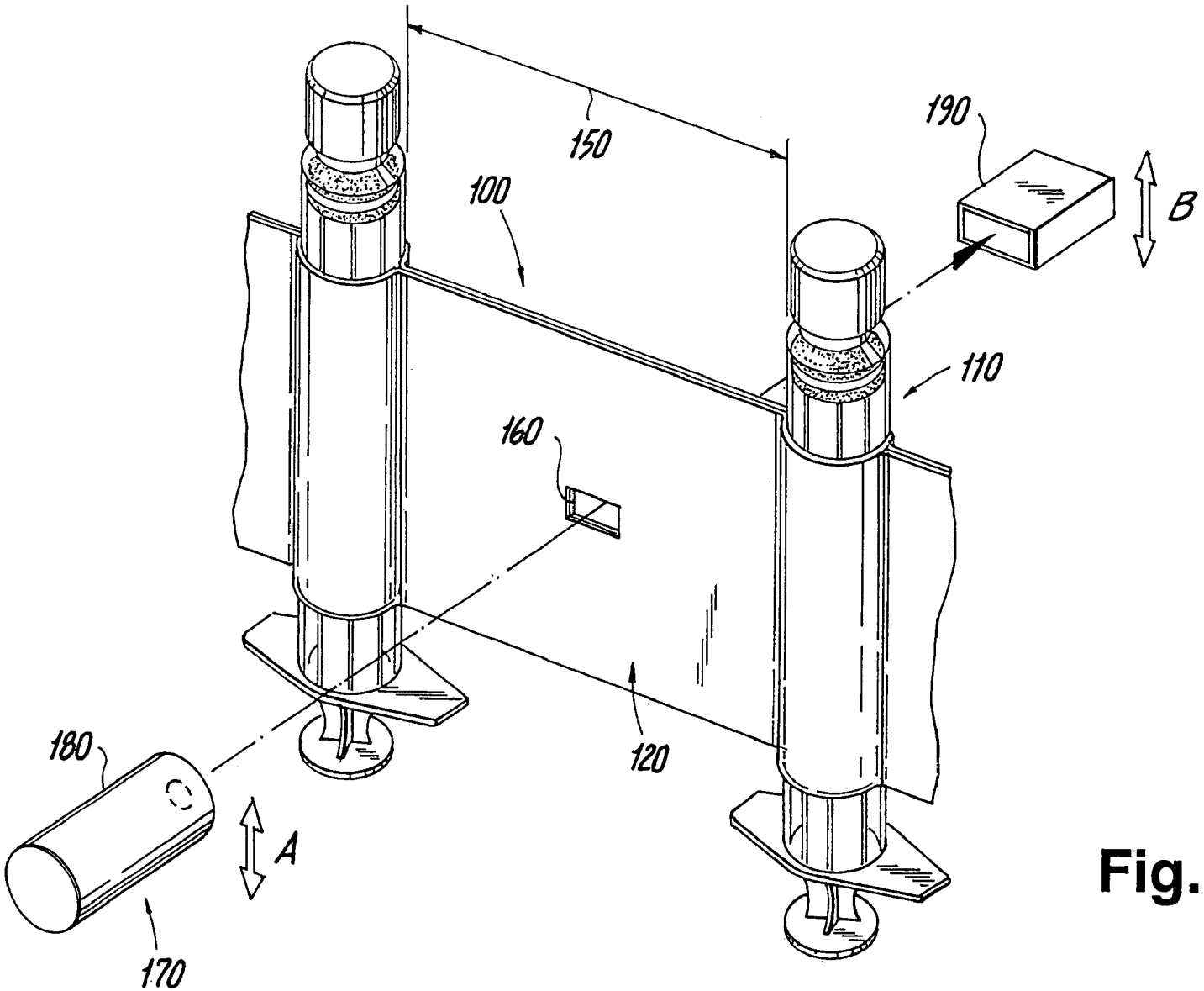
FIG. 4 is a perspective view of the syringe bandolier of FIG. 1 used in combination with a detection mechanism.

Referring to FIGS. 2–4, in one embodiment, the control feature 160 is an aperture formed in the prescribed interval 150 at a specific location thereof. For example, the control feature 160 can be in the form of an aperture having a square shape. The system 10 (FIG. 1) typically includes a laminar flow of air about the stations and rotary apparatus 40 to ensure that the system 10 is clean and remains in a clean state during operation. In a first embodiment, a detection mechanism 170 takes advantage of the presence of this laminar air flow by incorporating a nozzle 180 into the components providing the laminar air flow in the system 10. The nozzle 180 discharges a laminar air flow and if the bandolier 100 is precision fed into the system 10, proper alignment of the control feature 160 results and hence the syringe 110 can be ascertained by having the laminar air flow directed toward the bandolier 100 at the same height as the height that the control feature 160 is formed in the prescribed interval 150. In other words, the laminar air flow is in registration with the control feature 160 at select times when the aperture 160 and the laminar air flow align with one another. When the control feature (aperture) 160 and the laminar air flow are not in alignment, the laminar air flow simply strikes the strip 120 and does not pass therethrough.

In this embodiment, the detection mechanism 170 also includes a sensor 190 that is disposed on the opposite side of the bandolier 100 as compared to the nozzle 180. The sensor 190 is configured to detect the presence of the laminar air flow when the aperture and laminar air flow are in alignment. In this instance, the sensor 190 is of a type that detects the presence of the laminar air flow against the sensor 190 itself and in one embodiment, the sensor 190 is a pressure sensor. When the laminar air flow and the control feature 160 are in registration, the laminar air flow is permitted to flow cleanly through the aperture formed in the bandolier 100 and make contact with the sensor 190. The sensor 190 detects the presence of the laminar air flow and signals a controller (not shown) or the like of such detection. The controller is integrated into the system 10 such that upon receiving this signal, the controller then signals other components, such as the rotary apparatus 40, of the system 10 to advance the bandolier 100 a prescribed distance. It should be understood that the controller can respond to the pressure of the air flow through the control feature 160 or to a logical waveform resulting from the timing of air signals relative to periods without air signals (e.g., due to indexing of the bandolier 100).

Once the bandolier 100 is advanced the prescribed distance, another of the apertures (control feature) 160 is then axially aligned with the laminar air flow so long as the correct type of bandolier 100 for the system 10 is in place, the syringe orientation (up or down) is proper, and also the alignment of the bandolier 100 is proper. By integrating the detection mechanism 170 with the indexing components of the system 10, the distance between the control features 160 corresponds to the distance that the bandolier 100 is advanced upon receiving the control signal from the detection mechanism 170. Thus, the bandolier 100 is continuously advanced because each time the detection mechanism 170 is in recognition with the control feature 160, the bandolier 100 is advanced a distance that corresponds to the next control feature 160 being within a detection zone, thereby resulting in the detection mechanism 170 detecting the next control feature 160 and signaling the system 10 to further advance the bandolier 100.

It will be appreciated that the system 10 can thus easily be designed so that the bandolier 100 is continuously fed into the system 10, thereby permitting the system 10 to run continuously. The control feature 160 ensures proper alignment of the bandolier 100 and also ensures that the proper type of bandolier 100 is being used as the system 10 is configured to stop advancing the bandolier 100 if the detection mechanism 170 fails to read the control feature 160. For example, if the correct bandolier 100 is being used but the bandolier 100 becomes misaligned as it is being fed, the control feature 160 will not be in alignment with the nozzle 180 as the bandolier 100 is advanced. The detection mechanism 170 is preferably configured so that it will only advance the bandolier 100 a predetermined distance without detecting the control feature 160. If the control feature 160 is not detected over this predetermined distance, the detection mechanism 170 signals the controller or the like of the system 10 to stop advancement of the bandolier 100. Preferably, an error message is generated at the same time the bandolier 100 is stopped. Manual inspection is then performed to locate the problem.

Similarly, the system 10 is preferably a computer based system that receives user input. For example, the user can input the type of bandolier 100 that is being used in the system 10. In other words, the user is asked to input and identify the bandolier 100 by its common characteristics. Syringes 110 are commonly identified by their volume capacities and exemplary syringes that can be used with the system 10, include 12 ml (intravenous) and 25 ml (oral) syringes. The user preferably inputs the type of syringe (i.e., whether it is a 12 ml, 25 ml, or other size syringe) and then a microprocessor or the like will store this information and relay this information to the controller and detection mechanism 170. In order the have the detection mechanism 170 differentiate between the various different types of bandoliers 100, several techniques can be used.

Figure 5:
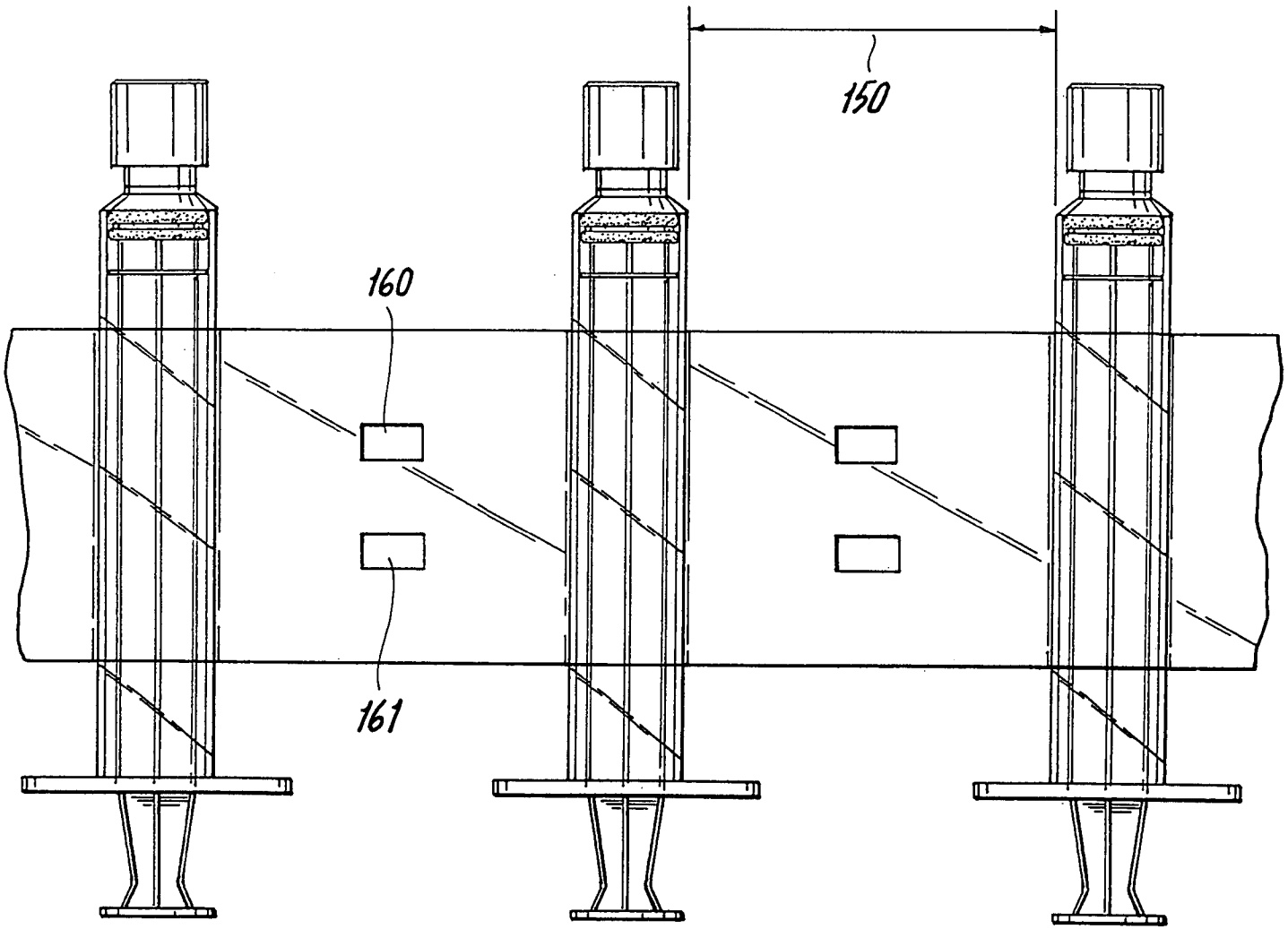
FIG. 5 is a side elevational view of a syringe bandolier according to another embodiment.

For example and according to one embodiment illustrated in FIG. 5, there are multiple control features 160 formed in the prescribed interval 150 according to a distinct pattern that is recognized by a detection mechanism (not shown). One exemplary pattern has one control feature 160 formed on top of another control feature 161 with the one control feature 160 being in the location that is associated with a syringe of a first type (e.g., 12 ml) and with a syringe of a second type (e.g., 25 ml) when the one control feature 160 is read along with the other control feature 161. The detection mechanism thus includes two nozzles and two sensors in this embodiment with one nozzle and one sensor for registration with the one control feature 160 and the other nozzle and sensor for registration with the other control feature 161. When the user inputs that the first type syringe bandolier 100 is being used, only the one nozzle and the one sensor are actuated, while if the user inputs that the second type syringe bandolier 100 is being used, both sets of nozzles and sensors are actuated. Some systems 10 may be specially configured to handle one syringe type, yet the syringe storage station 130 might be able to house multiple syringe sizes (e.g., smaller sizes than intended). If the detection mechanism 170 does not detect the control features 160, 161, the bandolier 100 is not advanced.

Referring to FIG. 4, an arrangement is shown in which the user can input the type of syringe to be used by the system to thereby permit automatic confirmation of alignment and bandolier type. In this arrangement, the precise location of the control feature 160 within the prescribed interval 150 can also be used to differentiate one bandolier type from another bandolier type. For example, the detection mechanism 170 can be driven by software such that the nozzle 180 and the sensor 190 are driven (see arrows A and B) to a prescribed coordinate location that corresponds to the type of bandolier 100 that is inputted into the system 10. This prescribed coordinate location is in registration with the control feature 160 that corresponds to the bandolier type inputted. For example, if the user enters that a 25 ml bandolier 100 is being used, the detection mechanism 170 (nozzle 180 and sensor 190) is moved to a first coordinate location (shown), while the detection mechanism 170 is driven to a second coordinate location (not shown) if the user enters that a 12 ml bandolier 100 is being used.

It will be appreciated that only a 25 ml bandolier 100 is formed to have a control feature 160 that assumes the first coordinate location at a point in time as the bandolier 100 is being advanced. Therefore, if the wrong type of bandolier 100 is used, proper registration between the control feature 160 and the detection mechanism 170 does not result and advancement of the bandolier 100 is stopped. Similarly, if the user enters that a 12 ml bandolier 100 is being used, the detection mechanism 170 will only detect bandoliers that have the control feature 160 formed at the second coordinate location.

Figure 6:
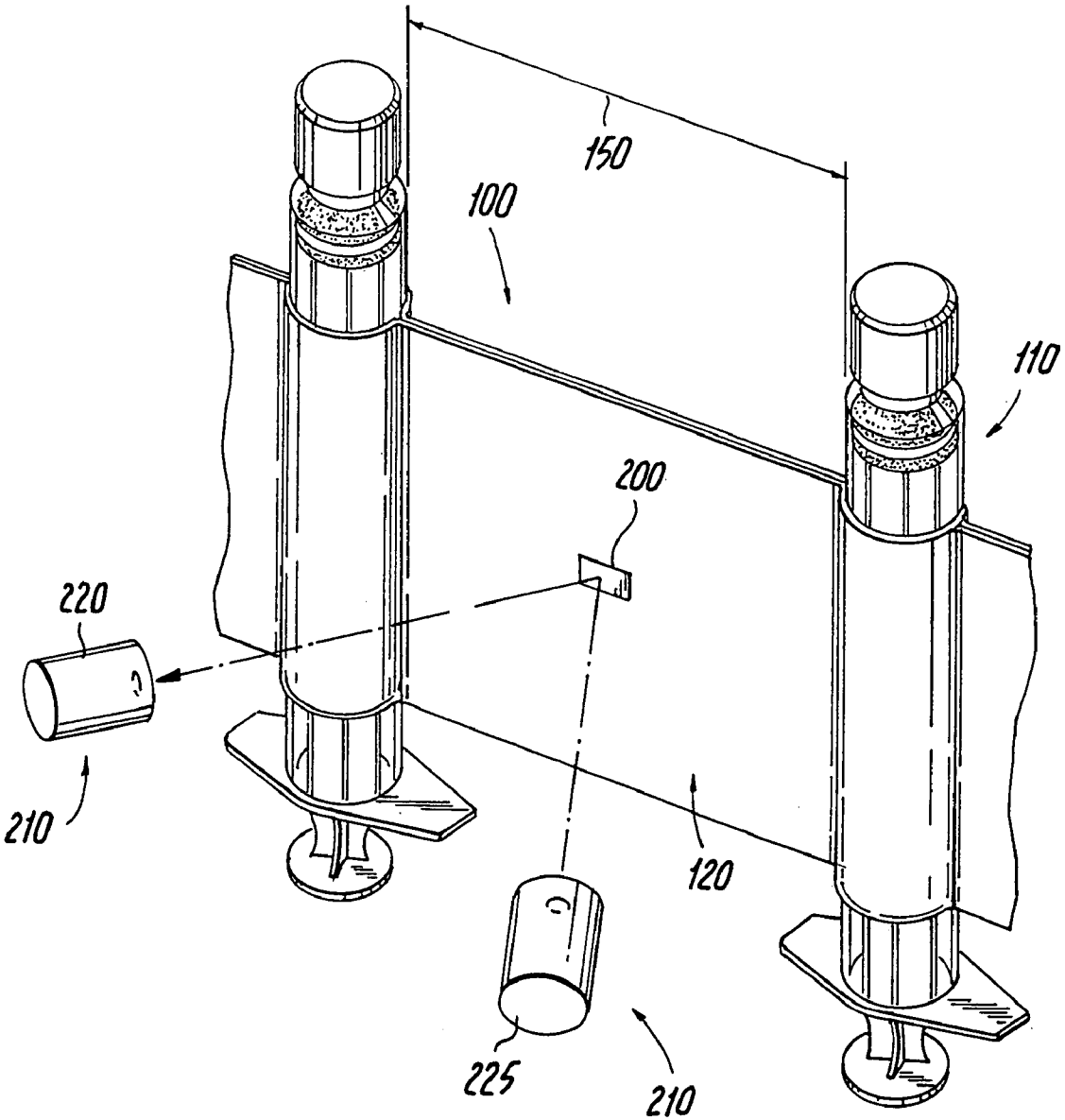
FIG. 6 is a perspective view of a syringe bandolier and a detection mechanism of another embodiment.

There are a number of different control features and detection mechanisms that can be used with the bandoliers. Now referring to FIG. 6, another exemplary control feature 200 is illustrated and generally indicated at 200 along with a detection mechanism 210 that is configured to be used with the control feature 200. In this embodiment, the control feature 200 is an optical feature that is used as part of an optical detection mechanism 210. As with the prior embodiment, the optical feature 200 is formed in the prescribed region 150 of the bandolier 100 with next adjacent optical features 200 being spaced a prescribed distance from one another.

Any conventional optical feature 200 that is suitable for use in the present application can be used. The detection mechanism 210 is a detection mechanism that optically detects the presence of the optical feature 200 when the optical feature 200 is in proper registration with an optical detector 220. For example, the optical detection mechanism 210 can include an optical detector 220 that faces the bandolier 100 as the bandolier 100 is advanced. The optical detector 220 cooperates with a light source, such as a laser or LED 225 that also faces the bandolier 100 to detect the presence of the optical feature 200. Advantageously, the light source and optical detector are arranged relative to each other in accordance with Snell's Law of Reflection; however, the light source and detector can be arranged otherwise, such as normal to and facing the optical feature 200. The feature 200 can come in a number of different shapes and sizes.

The optical detection mechanism 210 operates essentially in the same manner as the detection mechanism 170 of FIG. 4. In other words, the bandolier 100 is only advanced if the optical detection mechanism 210 reads the optical sensor 200. If the bandolier 100 is advanced a prescribed distance and the optical detection mechanism 210 does not read the optical sensor 200, the advancement of the bandolier 100 is stopped. Accordingly, proper registration between the optical sensors 200 and the detection mechanism 210 is needed for the bandolier 100 to be continuously advanced.

Figure 7:
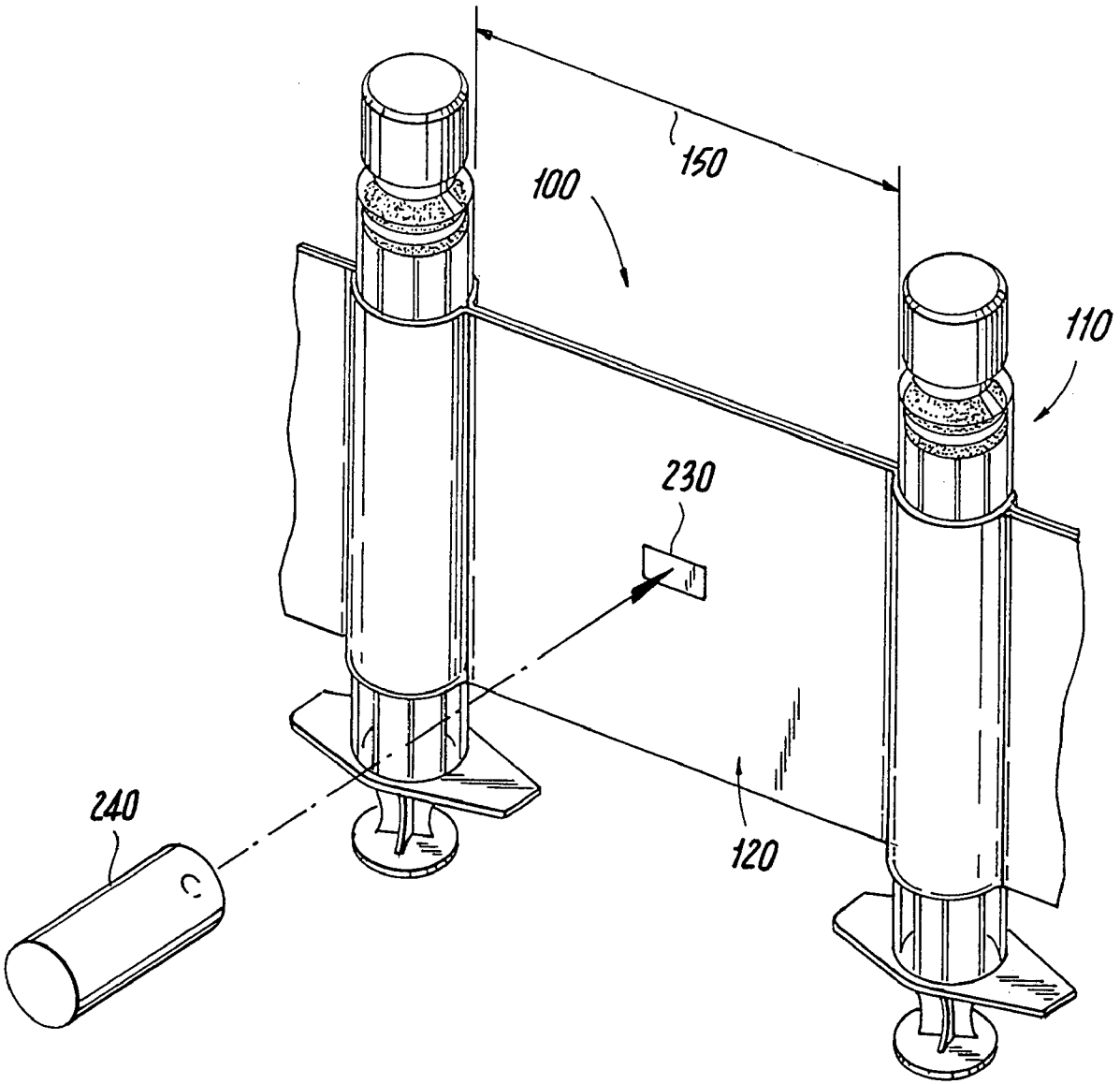
FIG. 7 is a perspective view of a syringe bandolier and a detection mechanism of yet another embodiment.

In yet another embodiment that is illustrated in FIG. 7, the control feature is a mark 230 that is formed within the prescribed interval 150 between spaced syringes 110 and a detection mechanism 240 is used for detecting the mark 230. The mark 230 can be any number of types of marks, including a printed mark that is formed on the surface of bandolier 100. As with the other embodiments, the detection mechanism 240 is used to detect the mark 230 and if a detection is not made within a prescribed time interval or during advancement of the bandolier 100 over a prescribed distance, the detection mechanism 240 signals a controller or the like to stop the advancement of the bandolier 100.

It will also be appreciated that when the control feature is an aperture formed through the bandolier 100 within the prescribed region 150, other types of detection mechanisms can be used rather than the pressure based detection mechanism discussed earlier. For example, the detection mechanism can be an ultrasonic system having an ultrasonic receiver and transducer. Ultrasonic waves are created one side of the bandolier 100 and are emitted toward the bandolier 100. When the control feature is in proper registration, the ultrasonic waves can pass through the aperture unimpeded and are detected on the other side of the bandolier 100. When the detection mechanism is ultrasonically based, the system preferably includes an integrator and comparator so that ultrasonic waves that pass through the aperture can be differentiated from ultrasonic waves that reach the detector by means other than passing through the aperture (control feature).

Another type of detection mechanism that can be used with the bandolier 100 is a thermal detection system. For example, the control feature 160 is still an aperture formed in the bandolier 100; however, the detection mechanism is a thermal based system that includes a thermal source (e.g., heat lamp) and a thermal detector. The thermal source, such as a heat lamp, is disposed on one side of the bandolier 100, while the thermal detector is disposed on the other side of the bandolier 100. The thermal source and the thermal detector are positioned so that the aperture is in registration therewith at a point in time as the bandolier 100 is advanced. The thermal detection mechanism is preferably coupled with an integrator and comparator. These two components permit the thermal detection mechanism to differentiate between heat that is detected across the aperture and heat that is detected through the bandolier 100 itself but outside of the aperture. Because heat that passes directly through the aperture is of higher intensity than heat that passes through the first and second layers 130, 140 of the bandolier 100, the integrator/comparator can differentiate between the different thermal energies and only permit advancement of the bandolier 100 when thermal energy passing through the aperture is detected.

Preferably, an ultrasonically, or heat or optically-based detection system includes logic such that the system does not merely detect ultrasonic waves, optical waves or heat waves but also analyzes the character, e.g., amplitude, of the waves. The detection system can therefore be configured to effectively filter out waves that do not meet certain criteria. The criteria is preferably a threshold that is achieved only when waves pass directly through the aperture (control feature) and are detected by the detection mechanism on the other side of the bandolier 100. Thus, waves that do not pass through the aperture but are otherwise detected on the other side of bandolier 100 do not register as a detection since they lack the prescribed criteria.

The control feature can comprise a segment of web material that permits passage of heat or light (of a given frequency, for example) while the remainder of the strip 120 is treated (e.g., coated) to block heat or light of prescribed frequencies. Thus, it can be appreciated that the control feature can take on a variety of forms to ensure proper handling of the bandolier type syringes.

It will also be appreciated that the detection systems employed for use with the syringe bandoliers described herein can operate with a higher degree of sophistication. For example, the detection system, and preferably the sensors thereof, can be connected a logic device that permits the detection system to look for and detect more sophisticated and complicated sensing patterns. The detection system (with logic) will search for distinct patterns associated with the control features. For example and with reference to FIG. 4, the sensor 190 can be designed so that not only does it determine the presence of a force against it but it also records the degree of that force (e.g., a pressure measurement (psi)). A control psi is previously determined and represents a range of psi measurements that should be measured by the sensor when the overall system is working fine. A comparator is used to compare the present psi measurement, that is being detected by the sensor, with the control psi. If the detected psi is not within the psi control range, a signal is generated and delivered to a controller or the like to stop the advancement of the bandolier. Such a scenario could occur if the user modified the equipment by moving the nozzle into close proximity with the sensor so that a continuous pressure was exerted on the sensor. In this case, the detected psi would exceed the control psi.

It will also be appreciated that the logic can be configured so that the sensor is searching for a distinct sensing pattern in which no signal is sensed for a first time period before a signal is sensed and then no signal is sensed again for the first time period. In other words, the sensor does not receive stimulus all the time but rather at select times and for select periods of time. This is the case in the detection system illustrated in FIG. 4. If the user modifies the detection system by placing the nozzle next to the sensor so that a laminar air flow is always present against the sensor, the detection system will stop advancing the bandolier since the sensing pattern does not match the sensing pattern that results when the system is operating properly.

In yet another aspect, the detection system can be linked to a communications network so that the detection system (or parts thereof) can be signaled from remote locations. For example, the sensor of the detection system can have a communications port that is in communication with a remote controller. An individual at a remote site can use the remote controller and signal the sensor to go offline. Conventional signal addressing protocol can be used so that the remote controller can be used to control a number of detection systems that are located in different places but all linked to the communications network. This permits the detection system to be by-passed when conditions require such action or for other reasons when it may be desirable to disable the detection system.

By incorporating a control feature into the syringe bandolier, performance deficiencies that were associated with automated systems that use syringes have been eliminated. For example, the use of the control feature provides the user with sufficient advance notification that the syringe bandolier is being misfed since the bandolier will not be advanced when the detection system fails to properly sense the control feature. This, in turn, prevents fluids from being ejected onto the automated deck in case of a misalignment. Another problem associated with conventional syringe based automated systems is that syringes of the wrong size or type are inserted into the system. This problem is also overcome by the present syringe bandolier because the use of control features ensures that only syringes of the correct type are used.

It will be appreciated by persons skilled in the art that the present invention is not limited to the embodiments described thus far with reference to the accompanying drawing. Rather the present invention is limited only by the following claims.

What is claimed:

1. A bandolier of syringes for use in a controllable syringe handling system, the bandolier comprising: a web; a multiplicity of syringes affixed to the web at a prescribed interval selected to permit handling by the controllable syringe handling system; and a control feature at a prescribed location relative to the web which is disposed within the prescribed interval and between adjacent syringes, the control feature being configured to interact with the controllable syringe handling system so as to influence handling operations of the syringe handling system including the advancement of the bandolier, wherein the prescribed location of the control feature relative to the web indicates to the controllable syringe handling system that at least one physical parameter related to a structure of the syringe is within an acceptable value.

2. The bandolier of claim 1, wherein the control feature is a mark formed on a surface of the web.

3. The bandolier of claim 1, wherein the web is formed of at least one plastic sheet.

4. The bandolier of claim 1, wherein the web comprises first and second strip layers, the multiplicity of syringes being disposed between the first and second strip layers with the prescribed interval being defined by the first and second strip layers disposed between adjacent syringes.

5. The bandolier of claim 4, wherein the first and second strip layers are in intimate contact the multiplicity of syringes and the first and second strip layers are sealed against one another in the prescribed interval.

6. The bandolier of claim 1, wherein the control feature has a first reflective characteristic and the web surrounding the feature has a different second reflective characteristic.

7. The bandolier of claim 1, wherein there is a correlation between a location of the control feature in the prescribed interval and a type of syringe that is bound to the web.

8. A control system for an automated syringe handling system, the control system comprising: an indexer configured to advance a syringe through the automated syringe handling system; a bandolier of syringes supplying syringes to the indexer, the bandolier including: a web, a multiplicity of syringes affixed to the web at a prescribed interval, and a control feature disposed within the prescribed interval and between adjacent syringes, the control feature being different from the surrounding web; and a detection system including a detector positioned to detect the control feature on the bandolier and perform a prescribed operation in response to the detection or non-detection of the control feature, wherein the detector determines whether the bandolier is properly aligned in the syringe handling system and whether at least one of a dimension of the syringe and a volume of the syringe is acceptable for use in the controllable syringe handling system based on either detection or non-detection of the control feature.

9. The control system of claim 8, further including a controller for advancing the bandolier, the controller being in communication with the detection system and the detection system being configured such that the detector sends a first signal to the controller upon sensing the control feature.

10. The control system of claim 9, wherein the first signal directs the controller to advance the bandolier a prescribed distance.

11. The control system of claim 8, wherein the detector is an optical detector arranged in cooperation with a light source and the control feature is an optical feature, the detector and light source detecting the optical feature of the bandolier when the optical feature is in proper registration therewith, the bandolier only being advanced if the optical feature is detected by the optical detector as the bandolier is advanced a predetermined distance.

12. The control system of claim 8, wherein the detector detects waves selected from the group consisting of ultrasonic waves, optical waves, and thermal energy waves, the detector further including logic that permits the one or more characteristics of the waves to be analyzed.

13. The control system of claim 12, wherein the one or more characteristics include an amplitude of the waves.

14. The control system of claim 8, wherein the control feature comprises a segment of the web that permits passage of at least one of heat and light having a first characteristic while the remainder of the web is treated to block at least one of heat and light having the first characteristic.

15. The control system of claim 8, further including a controller for advancing the bandolier in the automated syringe handling system, the controller being in conmiunication with the detection system, the bandolier being advanced only if the detection system detects the control feature within prescribed criteria.

16. The control system of claim 15, wherein the prescribed criteria is one of a predetermined time period and a predetermined distance that the bandolier has been advanced.

17. The control system of claim 9, wherein the distance between control features corresponds to the distance that the bandolier is advanced upon receiving the first signal.

18. The control system of claim 9, wherein the controller advances the bandolier only a predetermined distance without detecting one control feature.

19. The bandolier of claim 1, wherein the prescribed location between the adjacent syringes is representative and indicative of a characteristic of the syringes that form the bandolier.

20. The bandolier of claim 1, wherein the control feature is formed in a web segment that permits passage of a control signal and the web surrounding the web segment is treated to block passage of the control signal.

21. A bandolier of syringes for use in a controllable syringe handling system, the bandolier comprising: a web; a multiplicity of syringes affixed to the web at a prescribed interval selected to permit handling by the controllable syringe handling system; and a control feature at a prescribed location relative to the web which is disposed within the prescribed interval and between adjacent syringes, the control feature being configured to interact with the controllable syringe handling system so as to influence handling operations of the syringe handling system, wherein the control feature is formed at a prescribed coordinate location of the web between adjacent syringes, the prescribed coordinate location representing and indicating a specific bandolier type by indicating whether at least one of a dimension of the syringe and a volume of the syringe is acceptable for use in the controllable syringe handling system.

22. The bandolier of claim 21, wherein the prescribed coordinate location corresponds to a barrel volume of the bandolier.

23. The bandolier of claim 21, wherein a first prescribed coordinate location is associated with and indicates a syringe of a first type, whereas another prescribed coordinate location is associated with and indicates a syringe of second type that is different from the first type.

24. A bandolier of syringes for use in a controllable syringe handling system, the bandolier comprising: a web, a multiplicity of syringes affixed to the web at a prescribed interval selected to permit handling by the controllable syringe handling system; and a control feature at a prescribed location relative to the web which is disposed within the prescribed interval and between adjacent syringes, the control feature being configured to interact with the controllable syringe handling system so as to influence handling operations of the syringe handling system including the advancement of the bandolier, wherein the prescribed location of the control feature relative to the web indicates to the controllable syringe handling system a proper alignment of the bandolier of syringes within the controllable syringe handling system.

* * * * *